US006253444B1

(12) United States Patent
Le Neve

(10) Patent No.: US 6,253,444 B1
(45) Date of Patent: Jul. 3, 2001

(54) METHOD FOR THE MANUFACTURE OF ELBOWS FOR MICROWAVE GUIDES

(75) Inventor: Alain Le Neve, Fontenay aux Roses (FR)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/315,630

(22) Filed: May 20, 1999

(30) Foreign Application Priority Data

May 20, 1998 (EP) ..... 98460015

(51) Int. Cl.[7] ..... H01Q 13/00

(52) U.S. Cl. ..... 29/600; 29/825; 29/826; 29/601

(58) Field of Search ..... 29/600, 825, 826, 29/601; 333/34

(56) References Cited

U.S. PATENT DOCUMENTS

| | | | | |
|---|---|---|---|---|
| 3,247,574 | * | 4/1966 | Wirtz | 29/600 |
| 4,743,915 | * | 5/1988 | Rammos et al. . | |
| 4,783,663 | * | 11/1988 | Rammos et al. . | |
| 4,885,839 | * | 12/1989 | Ben-Dov | 29/600 |
| 4,887,346 | * | 12/1989 | Bertaian | 29/600 |
| 5,568,160 | * | 10/1996 | Collins . | |

* cited by examiner

*Primary Examiner*—Carl J. Arbes

(57) ABSTRACT

To manufacture an elbow comprising an internal tunnel formed by two rectilinear sections that meet in defining a dihedron on the internal side of the change in direction and, on the opposite side, a stepped transition face, the disclosed method consists of the making, by machining in one block, from two connection faces, of two rectangular boreholes that meet so that, at their meeting place, they define said dihedron on the internal side of the change in direction and said stepped transition face on the external side of the change in direction.

4 Claims, 2 Drawing Sheets

METHOD FOR THE MANUFACTURE OF ELBOWS FOR MICROWAVE GUIDES

BACKGROUND OF THE INVENTION

CROSS REFERENCE TO RELATED APPLICATION

This application claims priority of European Patent Application No. 98460015.5, which was filed on May 20, 1998.

1. Field of the Invention

The present invention relates to the manufacture of elbows for rectangular microwave guides.

Elbows for rectangular microwave guides are used to make directional changes of approximately 90 degrees or less, both in the plane E containing the electrical field and in the plane H containing the magnetic field.

2. Description of the Related Art

Several designs of elbows exist at present. A first type of elbow consists of a tube with a folded rectangular section to whose ends connection flanges are attached by soldering. A monolithic version of this type of elbow is manufactured by molding according to the method known as the lost-wax method. In both cases, the cost of manufacture is relatively high.

Another type of elbow is obtained from two complementary parts in each of which a half-tunnel equal to the entire length of the elbow is hollowed out from a plane connection face. The two half-tunnels are then placed so as to face each other and the two parts are joined by means of a plurality of screws. In this way, elbows are made with their tunnel, on the side external to the change in direction, having a transition face with a sequence of steps or levels. This design enables the use of simple and efficient machining technologies such as milling. However, the assembling of the two parts by screws may give rise to defects of coincidence between the two half-tunnels. These defects, however minute they might be, could have harmful effects. Furthermore the assembling screws, which must be sufficient in number to provide for a satisfactory link, take up a considerable volume of the material of the two parts and therefore hinder the miniaturization desired for most applications.

The invention is the result of research conducted on elbows for rectangular microwave guides with a view to achieving the following goals: simplicity of manufacture giving rise to an economical cost price, efficient reproducibility to enable mass production within tight tolerance values, high aptitude for miniaturization through the utmost elimination of the constraints of space requirement other than those inherent in the functional dimensions.

SUMMARY OF THE INVENTION

To this end, the invention consists of a method for the manufacture of an elbow for rectangular microwave waveguides, said elbow comprising an internal tunnel formed by two rectilinear sections that meet to define a dihedron on the internal side of the change in direction and, facing the peak of said dihedron, on the external side of the change in direction, a stepped transition face, wherein the method consists of the making, by machining in one block, from two faces of said block forming the connection ends of the elbow, of two rectangular boreholes that meet so that, at their meeting place, they define said dihedron on the internal side of the change in direction and said stepped transition face on the external side of the change in direction.

Provided that the steps of said transition face are straight steps, said boreholes can advantageously be made by the milling technique which provides a totally satisfactory degree of precision for the applications aimed at (working at frequencies of 10 to 20 GHz) and would remain sufficient well beyond these frequencies (at least up to 60 GHz).

Furthermore, in the monolithic elbow thus made, the totality of the volume of remaining material becomes available to receive fastening screws for the elements to which it will be connected thus enabling a maximum reduction of this volume of material and therefore of the total space requirement of the elbow.

BRIEF DESCRIPTION OF THE DRAWINGS

The characteristics and advantages of the invention mentioned here above, as well as others shall appear more clearly from the following description made with reference to the appended drawings, of which.

MORE DETAILED DESCRIPTION

Figure 1:
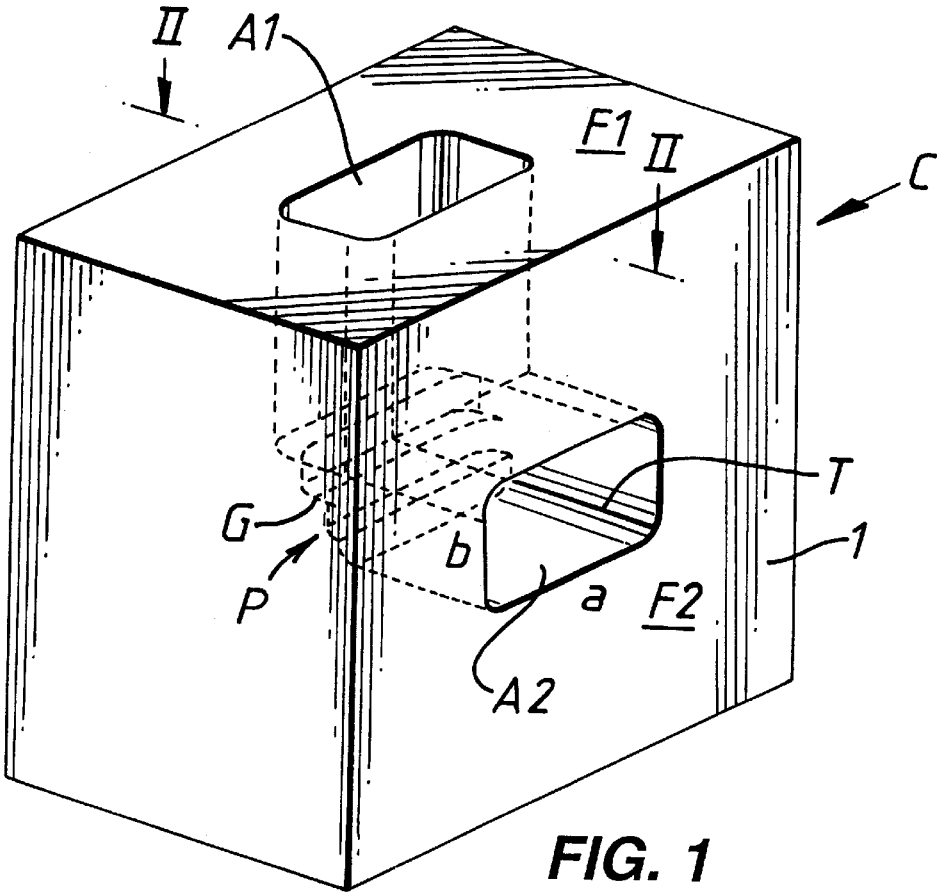
FIG. 1 is a schematic view in perspective of an elbow made according to the present invention.
Figure 2:
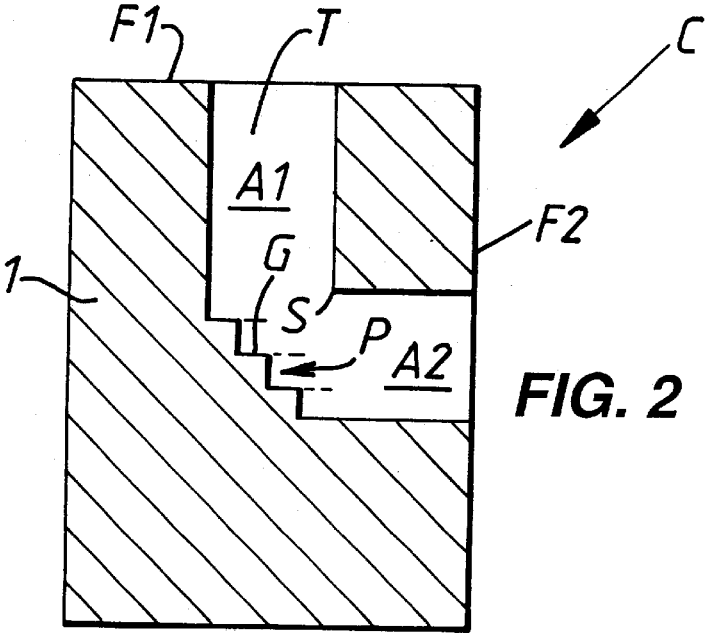
FIG. 2 is a sectional view along the line II—II of FIG. 1.

If we consider first of all FIGS. 1 and 2, they illustrate the invention by representing an elbow C for a rectangular microwave waveguide. This is a right-angled elbow with a change in direction in the plane E (containing the electrical field) corresponding to the height b of the guide. It is made of a standard material such as an aluminum alloy.

The elbow C consists of a parallelepiped block 1 with two orthogonal connection faces, respectively F1 and F2, between which the internal guiding tunnel T has been machined. In practice, this tunnel consists of two orthogonal boreholes A1, A2 with a rectangular section (a, b) respectively formed out of the faces F1 and F2. These two orthogonal boreholes A1, A2 meet in defining, on the internal side of the change in direction (FIG. 2), a straight dihedron with a peak S and, on the external side of the change in direction, a cut-corner transition face P substantially at 45 degrees, facing the peak S and formed by a succession of steps G. The steps G are straight steps. Each of them therefore has a wall parallel to the walls with a width a of the borehole A1 and a wall parallel to the walls with a width a of the borehole A2.

The elbow C is advantageously made by milling, for example by a machining process in which, first of all, the borehole A1 is made with a back that is stepped on one of its sides to form the set of steps G. After this, the borehole A2 is made. As a variant, it is possible to stop the machining of the borehole A1 at the first step, namely the highest step in this borehole, or to stop the machining at an intermediate step, and then make the remaining steps during the machining of the borehole A2.

Figure 3:
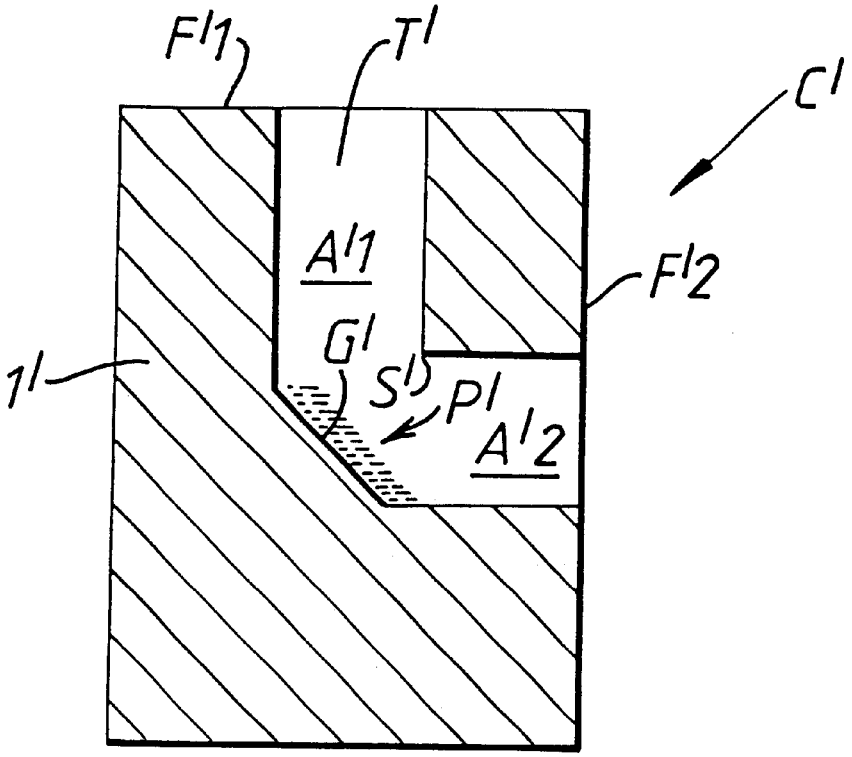
FIG. 3 is a view similar to that of FIG. 2 showing a second exemplary embodiment of an elbow made according to the present invention.

FIG. 3 shows an elbow of the same design as the elbow C described here above which shows all its characteristics and consequently has the same references along with the prime sign. The elbow C' can also be made by milling as explained in the previous paragraph and it actually differs from the elbow C only in the fact that its steps G' have their number considerably increased as compared with the number of the steps G, their dimensions of course being reduced to a corresponding degree can be seen in the succession of parallel lines of fine dots and dashes giving a schematic view of the machining increments in one dimension. As a result, the transition face P' becomes a plane wall or more precisely it can be likened in practice to a plane wall in which henceforth the step levels G' no longer have any effect other than that of giving it a certain roughness.

Figure 4:
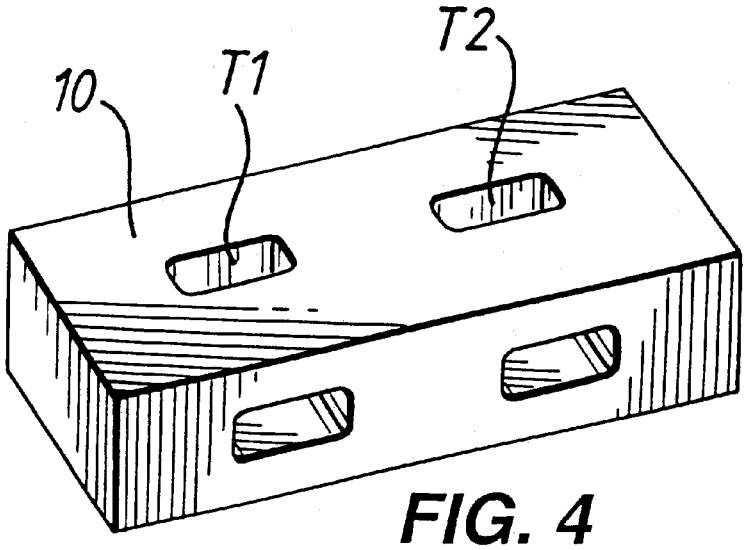
FIG. 4 is a schematic view in perspective of a block comprising two elbows made according to the present invention.

FIG. 4 illustrates another advantage of the invention enabling several elbows to be associated in the form of several guidance tunnels T1, T2 machined side by side in a single block 10.

It goes without saying that the above description pertaining to elbows designed for changes in direction in the plane H is also valid for elbows designed for changes of direction in the plane E which can be made exactly in the same way.

What is claimed is:

1. A method for the manufacture of an elbow for rectangular microwave waveguides, said elbow comprising an internal tunnel formed by two rectilinear sections that meet to define a dihedron on the internal side of the change in direction and, facing the peak of said dihedron, on the external side of the change in direction, a stepped transition face, wherein the method consists of the making, by machining in one block, from two faces of said block forming the connection ends of the elbow, of two rectangular boreholes that meet so that, at their meeting place, they define said dihedron on the internal side of the change in direction and said stepped transition face on the external side of the change in direction.

2. A method according to claim 1 for the manufacture of an orthogonal elbow, wherein the tunnel is machined by milling, the steps being straight steps made during the milling of one of the boreholes.

3. A method according to claim 1 for the manufacture of an orthogonal elbow, wherein the tunnel is machined by milling, the steps being straight steps, a part of the steps being made during the milling of one of the boreholes and the remaining part being made during the milling of the other borehole.

4. A method according to one of the claim 1 wherein the transition face is made with a large number of small-sized steps so that it is an almost plane wall.

* * * * *